US005454731A

United States Patent [19]

Dickie

[11] Patent Number: 5,454,731

[45] Date of Patent: Oct. 3, 1995

[54] LOW PROFILE ELECTRICAL PLUG HAVING PLASTIC PULL TAB

[75] Inventor: Robert G. Dickie, Newmarket, Canada

[73] Assignee: Paige Manufacturing Inc., Kin City, Canada

[21] Appl. No.: 275,616

[22] Filed: Jul. 6, 1994

[51] Int. Cl.[6] ..... H01R 19/04

[52] U.S. Cl. ..... 439/484; 439/694

[58] Field of Search ..... 439/483, 484, 439/476, 347, 372, 692, 694

[56] References Cited

U.S. PATENT DOCUMENTS

| | | | |
|---|---|---|---|
| 1,353,699 | 9/1920 | Aguere | 439/483 |
| 4,857,013 | 8/1989 | Peters | 439/484 |
| 4,927,376 | 5/1990 | Dickie | 439/484 |
| 5,057,036 | 10/1991 | Dickie | 439/484 |

FOREIGN PATENT DOCUMENTS

| | | | |
|---|---|---|---|
| 2563383 | 10/1985 | France | 439/484 |
| 2227132 | 7/1990 | United Kingdom | 439/484 |

*Primary Examiner*—Gary F. Paumen
*Assistant Examiner*—Hien D. Vu
*Attorney, Agent, or Firm*—Donald E. Hewson

[57] ABSTRACT

A molded plastic low profile electrical plug comprising a thin molded plastic main body member, two electrically conductive blade members adapted for insertion into an electrical outlet, and two wire members forming an electrical cord, is disclosed. A removal handle receiving aperture is open to the back face of the main body member. A molded plastic removal handle having a base portion and a handle portion joined in flexible relation to the base portion, is situated with the base portion within the removal handle receiving aperture such that the main body member and the base portion of the removal handle are in interference fit with each other, so as to securely retain the removal handle in the removal handle receiving aperture. The handle portion is flexibly movable between an in-use position and an offset position. When the handle portion is in its in-use position it extends generally perpendicularly outwardly from the back face of the main body member so as to be readily graspable. The resultant line of action of a pulling force transmitted through the molded plastic removal handle is oriented generally parallel to the longitudinal axes of the two electrically conductive blade members, thus having an effective point of application located substantially midway between the two electrically conductive blade members. In this manner, the pulling force is distributed relatively evenly between the two electrically conductive blade members, to thereby facilitate ready removal of the electrical plug from an electrical outlet.

13 Claims, 4 Drawing Sheets

FIG. 6
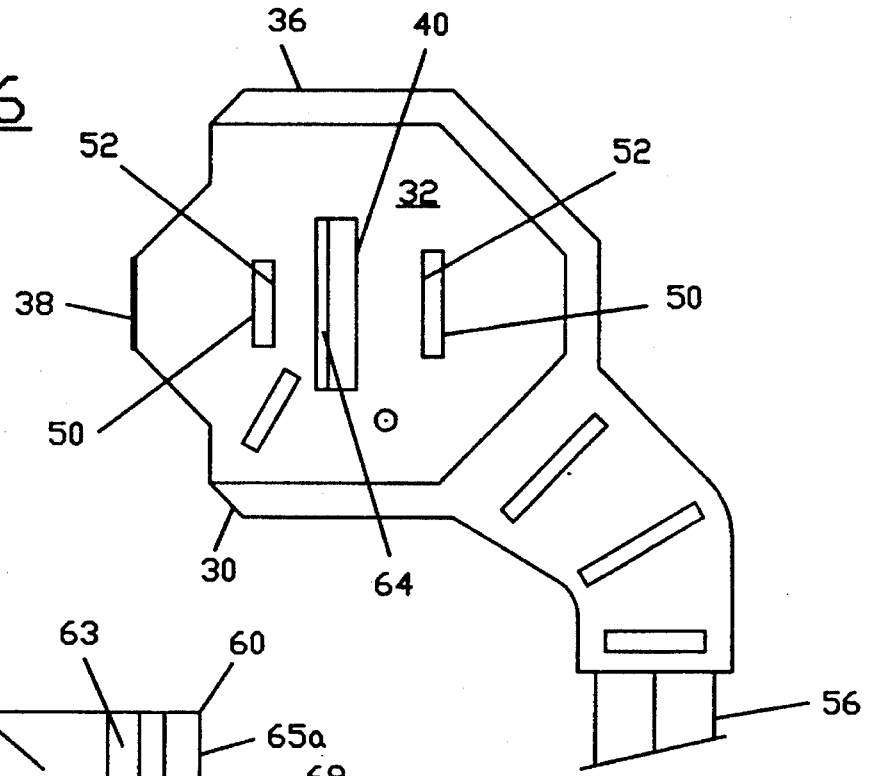
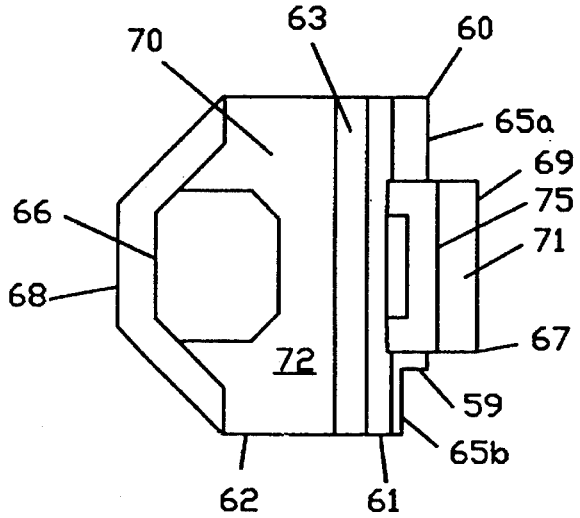
FIG. 9
FIG. 10
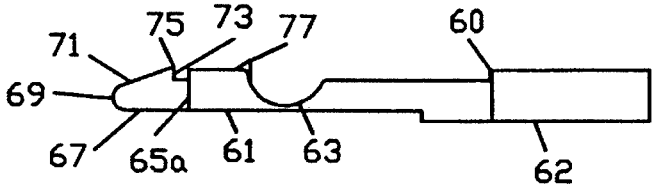
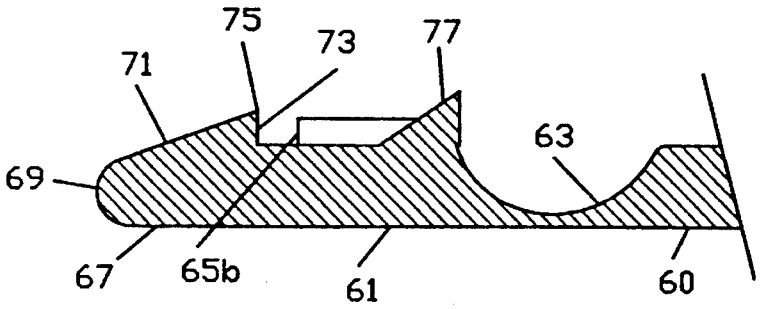
FIG. 11

LOW PROFILE ELECTRICAL PLUG HAVING PLASTIC PULL TAB

FIELD OF THE INVENTION

This invention relates to electrical plugs for use in conjunction with conventional electrical outlets, and more particularly to low profile space-saving types of electrical plugs. In particular, this patent application relates to tabs having electrical plugs attached to such to facilitate their removal from outlets. Moreover, a particular embodiment of this application relates to such low profile electrical plugs used as part of an electrical extension cord.

BACKGROUND OF THE INVENTION

Over the past few years, various types of low profile electrical plugs have been developed, for use in conjunction with conventional 110 VAC electrical outlets or receptacles, such as those typically used in residential and commercial buildings. On particular reason for development of such low profile electrical plugs is to permit furniture to be placed immediately juxtaposed to a wall, or at least very close thereto, in front of an electrical outlet. Conventional profile electrical plugs extend outwardly from an electrical outlet for perhaps one inch to about two inches or more, and therefore often preclude a piece of furniture from being placed immediately juxtaposed to a wall. It follow that low profile electrical plugs having tabs to facilitate their removal from electric outlets are inherently safer, as there is no chance that the fingers of a user will contact the blades of the plug while they are still alive electrically.

One example of a low profile type electrical plug can be found in Dickie U.S. Pat. No. 4,927,376, which is commonly owned herewith. This low profile electrical plug has a main body that is about ¼ inch thick, with the electrical wire coming out from one corner or end of the plug. Accordingly, it is necessary to utilize a pull ring as part of the electrical plug in order to remove the electrical plug from the outlet.

The pull ring is the subject matter of U.S. Pat. No. 5,057,036, which is also commonly owned herewith, and which teaches electrical plugs that are sold extensively throughout North America in association with the trademark FLATPLUG. The pull ring—which is formed from metal, for reasons of strength—is pivotally attached in a semi-permanent manner to the main body of the electrical plug, so as to preclude removal of the pull ring from the main body of the electrical plug during normal usage or by way of significant efforts directed at such removal. In other words, this pull ring arrangement is quite robust. The pivoting pull ring is fashioned with lock stubs bent at three serial right angles at each secured end of the pull ring, so as to be securely retained within respective co-operating lock stub cavities within the main body portion. A lock tab at each of the lock stub cavities partially defines the respective lock stub cavity and precludes the lock stub on the pull ring from being readily removed therefrom. During assembly of the electrical plug, the lock stub at each end of the pull ring deforms the respective lock tab to permit entry of the lock into the lock stub cavity. The lock tab is fashioned with a gradual ramp on the side away from the lock stub cavity to facilitate the gradual deformation of the lock tab as the lock stub is forced over the lock tab. Once the lock stub is in the lock stub cavity, the lock tab returns to its original position, which thereby locks the lock stub into the lock stub cavity. The side of the lock tab facing the lock stub cavity is fashioned with an abrupt vertical face which prevents the lock stub from deforming the lock tab from the lock stub cavity side, thereby permanently locking the lock stub into the lock stub cavity.

There are, however, some considerations surrounding the earlier type of pull ring, as used in conjunction with low profile electrical plugs. The main concern is that the electrical plug including the metal pull ring is relatively expensive to manufacture, especially since the pull ring must be relatively robust and it must be well anchored into the plug so that it cannot be readily removed. The metal pull ring must be first formed, then preferably coated with a tarnish and oxidation resistant outer coating, and then must be carefully and forcibly manipulated into place onto the main body of the electrical plug during the manufacturing operation. Moreover, the molding operation of the main body requires the use of moveable side cores in the mold, adding to the expense of making and operating the mold. Thus, this type of low profile electrical plug may be considered to be somewhat more expensive than is necessary for some applications.

It has been found that in electrical extension cords or appliance cords, the plugs of the extension cords may be plugged in and unplugged from the electrical outlet or receptacle only a few times—typically less than ten times—over the life of an extension cord or small appliance such as a high fidelity amplifier, television set, or floor lamp. Accordingly, in an extension cord comprising a low profile electrical plug, the ring or tab that is used to remove the electrical plug from an electrical outlet may not need to be as robust as other types of rings or tabs that might be used on electrical plugs on the electrical cord of perhaps a major electrical appliance such as a washer or refrigerator, sewing machine, microwave oven or the like, or a power tool. The pull tab or ring can potentially be made of the same molded plastic material as the main body of the electrical plug, so as to permit cost cutting at the manufacturing level.

A low-profile electrical plug having a molded plastic pull ring is disclosed in commonly owned U.S. Pat. No. 4,857,013 to Peters. As disclosed in this patent, the molded plastic pull ring may be integrally molded within the main body of the electrical plug so as to be bendable between a stored position against the main body and an in-use position whereat the molded plastic pull ring extends away from the main body. This particular configuration of integral molded plastic pull ring has a number of problems associated with it, including an unnecessarily large size of plug, and a tendency for the molded plastic pull ring to permanently bend or even break, as the shape hand orientation of the pull ring are not directed along the line of action of the pulling force when the electrical plug is being removed from an outlet. Alternatively, the molded plastic pull ring may be mechanically hinged onto the main body for movement between a stored position and an in-use position, as described above. This particular configuration of mechanically hinged plastic pull ring also has a number of problems associated with it including an unnecessarily large size of electrical plug, a tendency for the pull ring to pull out of the main body during use, and a tendency to be difficult and expensive to manufacture due to the inclusion of hinges.

It is an object of the present invention to provide an electrical plug having an integral molded plastic removal tab, which molded plastic low profile electrical plug is less expensive to manufacture than other types of molded plastic low profile electrical plugs.

It is an object of the present invention to provide an electrical plug having an integral molded plastic removal tab, that does not permanently deform as a result of use.

It is an object of the present invention to provide an electrical plug having an integral molded plastic removal tab, that does not readily break as a result of use.

It is an object of the present invention to provide an electrical plug having an integral molded plastic removal tab, that may not easily be pulled out of the main body as a result of regular use.

SUMMARY OF THE INVENTION

In accordance with one aspect of the present invention, there is provided a molded plastic low profile electrical plug comprising a thin molded plastic main body member having a generally flat front face in a first plane, a back face in a second plane substantially parallel to the first plane, and a perimeter edge adjoining the front and back faces, and at least one removal handle receiving aperture open to the back face of the main body member. Two electrically conductive blade members are securely retained by the main body member and extend outwardly from the front face thereof in a pattern suitable for insertion into a standard electrical outlet with each of the blade members having a generally centrally disposed longitudinal axis oriented substantially perpendicularly to the generally flat front face of the main body member, and each axis being oriented parallel to one another. The two wire members are each connected at a terminating end thereof in electrically conductive relation to a respective one of the blade members. The opposite end of each of the wire members extends outwardly from the main body member of the plug at the perimeter edge generally between the first and second planes. A molded plastic removal handle having a base portion and a handle portion, is joined in flexible relation to the base portion, with the base portion being situated within the removal handle receiving aperture such that the main body member and the base portion of the removal handle are in interference fit with each other, so as to securely retain the removal handle in the removal handle receiving aperture. The handle portion is flexibly movable between an in-use position and an offset position. When the handle portion is in its in-use position it extends generally perpendicularly outwardly from the back face of the main body member so as to be readily graspable and such that the resultant line of action of a pulling force transmitted through the molded plastic removal handle is oriented generally parallel to the longitudinal axes of the two electrically conductive blade members. Further, the pulling force has an effective point of application located substantially midway between the two electrically conductive blade members so as to distribute the pulling force relatively evenly between the two electrically conductive blade members, to thereby facilitate ready removal of the electrical plug from an electrical outlet. When the handle portion is in its offset position it subtends an acute or zero angle with respect to the back face of the main body member.

BRIEF DESCRIPTION OF THE DRAWINGS

Embodiments of this invention will now be described by way of example in association with the accompanying drawings in which:

FIG. 6 is a plan view from the front of the main body member of FIG. 4;

FIG. 9 is a top plan view the removal handle of FIG. 7;

FIG. 10 is a side elevational view of the removal handle of FIG. 7; and

FIG. 11 is an enlarged view of an end portion, shown encircled in FIG. 10.

Figure 1:
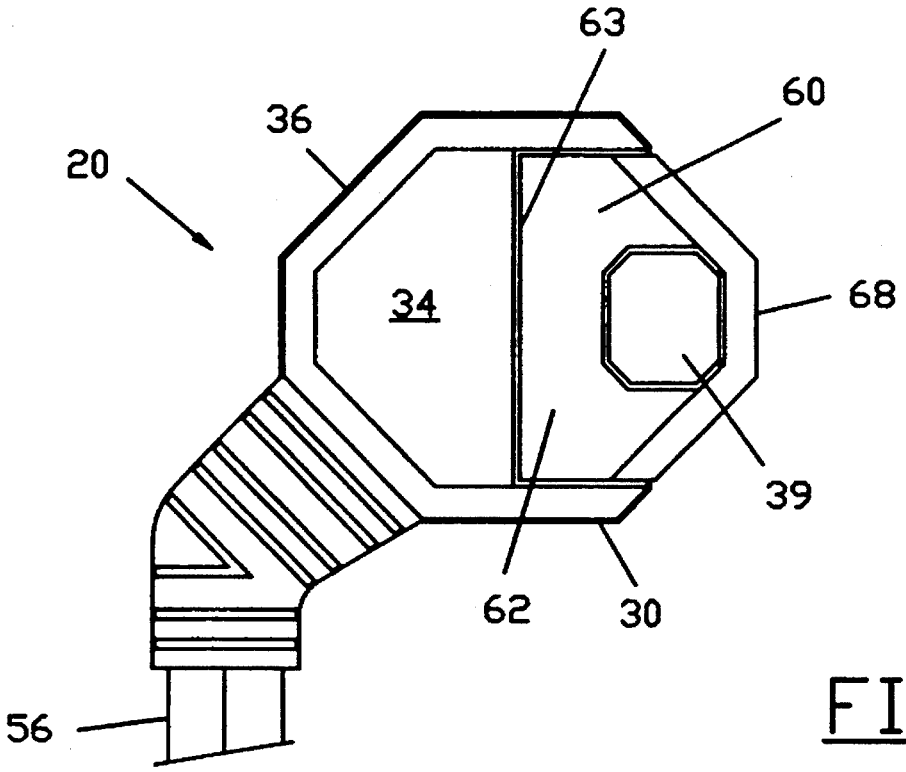
FIG. 1 is a plan view of the back face of the molded plastic low profile electrical plug of the present invention, with the removal handle in a closed off-set position.
Figure 2:
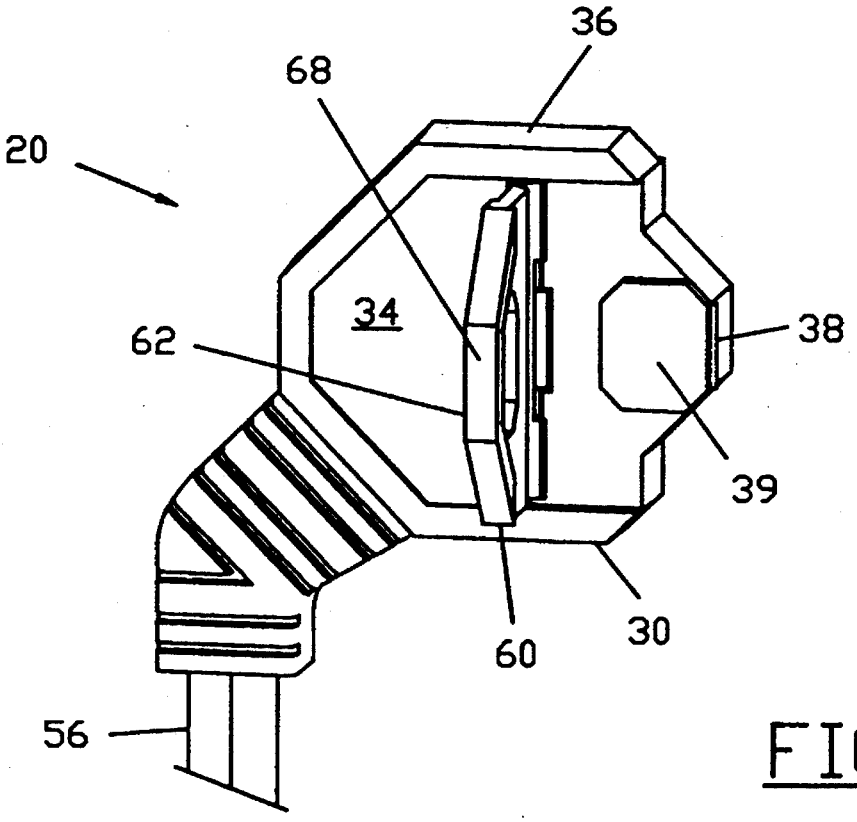
FIG. 2 is a perspective view from the back of the molded plastic low profile electrical plug of FIG. 1, with the removal handle in an in-use position.
Figure 3:
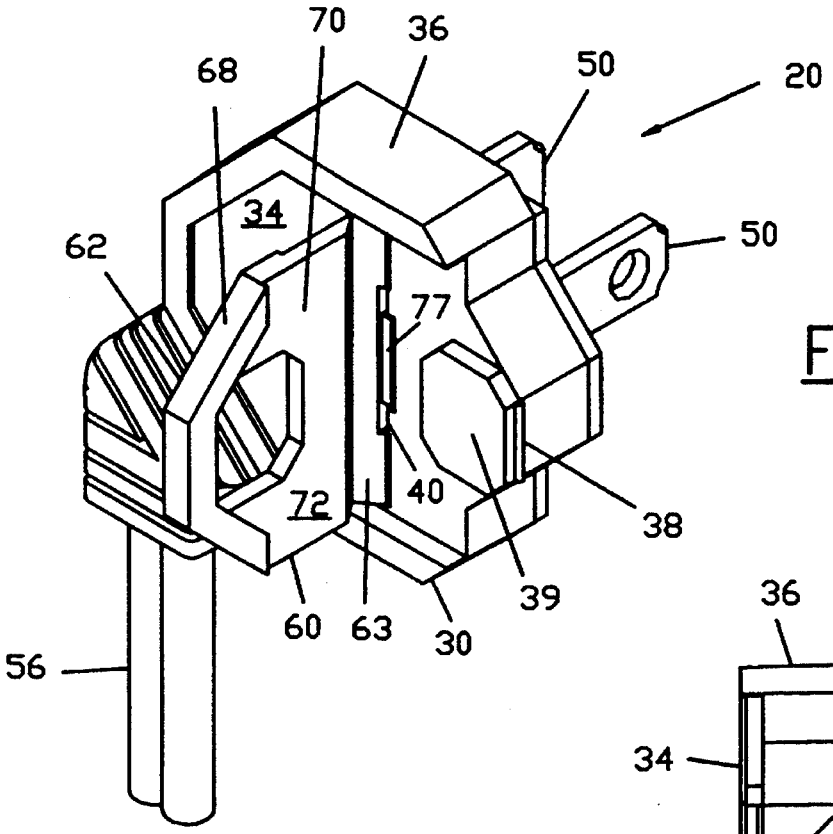
FIG. 3 is a perspective view similar to FIG. 2, but from a slightly different angle.
Figure 5:
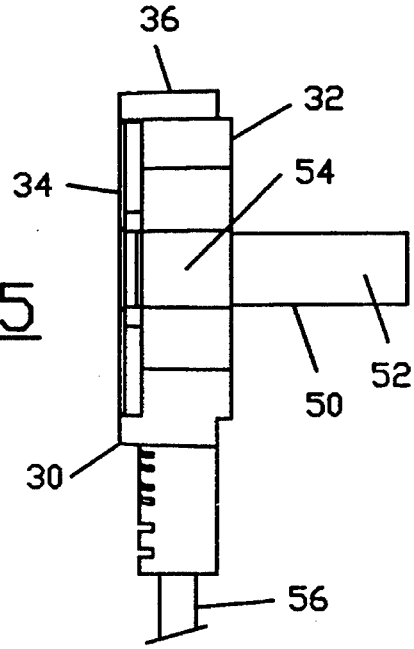
FIG. 5 is a side elevational view of the main body member of FIG. 4.
Figure 4:
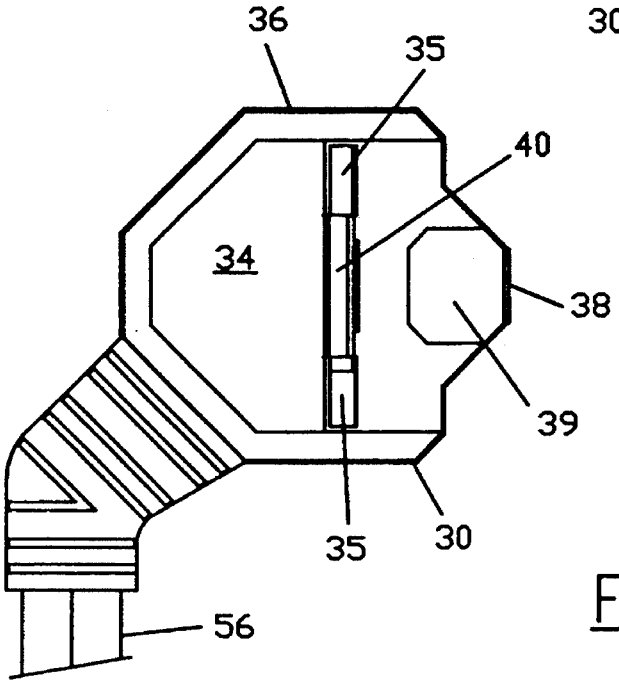
FIG. 4 is a plan view from the back of the main body member of the molded plastic low profile electrical plug of FIG. 1, without the removal handle installed.
Figure 7:
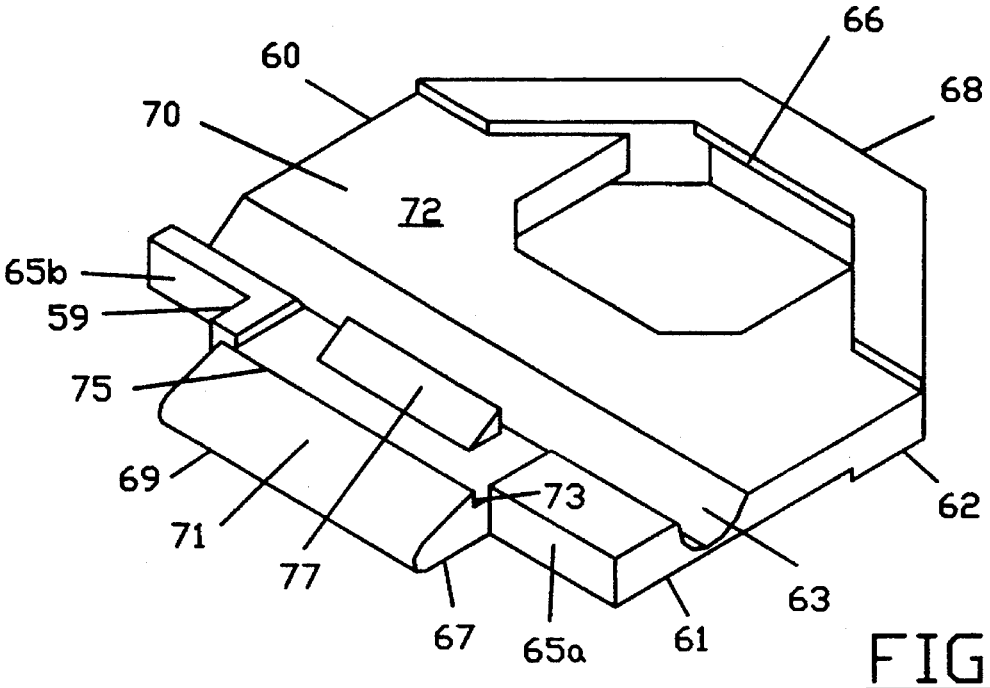
FIG. 7 is a is a perspective view of the removal handle before it is inserted into the main body member.
Figure 8:
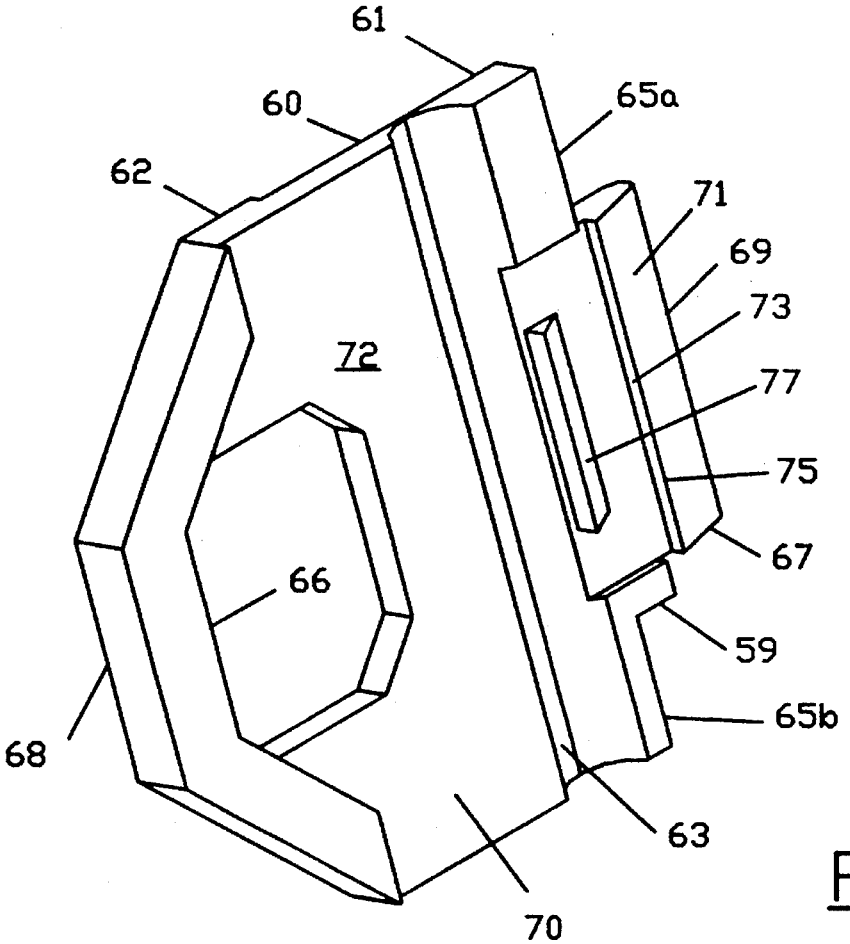
FIG. 8 is a perspective view of the removal handle of FIG. 7, shown from a slightly different angle.

DETAILED DESCRIPTION OF THE PREFERRED EMBODIMENTS:

Reference will now be made to FIGS. 1 through 11, which show the molded plastic low profile electrical plug of the present invention, as indicated by the general reference 20. As can be seen in FIG. 1, the molded plastic low profile electrical plug 20 is shown plugged into a conventional electrical outlet 22. In order to remove the low profile electrical plug 20 from the electrical outlet 22, it is necessary that the removal handle 60 be used. The removal handle 60 permits pulling of the low profile electrical plug 20 in a direction parallel to the length of the electrically conductive blades of the electrical plug 20, as will be described in greater detail subsequently.

The molded plastic low profile electrical plug 20 comprises a thin molded plastic main body member 30 having a generally flat front face 32 in a first plane. The generally flat front face 32 is thereby adapted to be juxtaposed to, or even to contact, the outer surface 24 of the electrical outlet 22 when the molded plastic low profile electrical plug 20 is in place in the electrical outlet 22. It is not strictly essential, however, that the front face 32 of the main body member 30 be generally flat in order for the molded plastic low profile electrical plug 20 of the present invention to work. The thin molded plastic main body member 30 also has a generally flat back face 34 in a second plane, which second plane is substantially parallel to the first plane. It is not imperative that the back face 34 of the thin molded plastic main body member 30 be generally flat; however, it is difficult to make a molded plastic low profile electrical plug 20 with a curved back face 34 since the outer portions of the main body member 30 would be undesirably thin or thick. The front and back faces 32 and 34 are adjoined by a perimeter edge 36.

The main body member 30 also comprises at least one removal handle receiving aperture 40 therein. In the preferred embodiment, as shown in the Figures, only one removal handle receiving aperture 40 is employed to receive the removal handle 60. Preferably, this removal handle receiving aperture 40 is an elongate slot disposed substantially midway between the electrically conductive blade members 50. It is highly desirable that the removal and handle receiving aperture 40 be located halfway between the two electrically conductive blade members 50 so that the line of action of the pulling force exerted on the removal handle 60 has an effective point of application located substantially midway between the two electrically conductive blade members 50 and therefore is distributed relatively evenly between the two electrically conductive blade members 50. Such even distribution of the pulling force between the two blade members 50 facilitates ready removal of the molded plastic low profile electric plug 20 from the electrical outlet 22. Although such even distribution of the pulling force between the two electrically conductive blade members 50 is highly desirable, it is not critical to the present invention. It is also quite acceptable to have two removal handle receiving apertures to receive the removal handle 60, as will be discussed in greater detail subsequently with respect to an alternative embodiment. The removal handle receiving aperture 40 is open to the back face 34 of the main body member 30, and also preferably extends completely through the main body member 30 so as to be open to the front face 32 of the main body member 30. It is not essential that the removal handle receiving aperture 40 extend to the front face 32 of the main body member 30; however, this preferably done for molding purposes as the internal structure of the removal handle receiving aperture 40 is relatively easy to form using a two piece mold if the receiving aperture 40 is open to both the back face 34 and the front face 32 of the main body member 30.

The molded plastic low profile electrical plug 20 also comprises two electrically conductive blade members 50, with each of the conductive blade members 50 having a blade portion 52 and a land portion 54. The conductive blade members 50 are securely retained by the main body member 30 by way of the land portions 52, which are substantially unmovably retained within the solid plastic portion of the main body portion 30. The two electrically conductive blade members 50 extend outwardly from the front face 32 of the main body member 30 in a pattern suitable for insertion into a standard 110 VAC electrical outlet 22. The blade portion of each of the blade members 50 has a generally centrally disposed longitudinal axis "A" oriented substantially perpendicularly to the generally flat front face 32 of the main body member 30, with the two longitudinal axes "A" being oriented parallel to each other. Such orientation of these longitudinal axes "A", and therefore the blade portions 52 of the two electrically conductive blade members 50, is necessary so that the electrically conductive blade members 50 will be properly aligned so as to be enterable into an electrical outlet 22, and also so that the generally flat front face 32 of the main body member 30 of the molded plastic low profile electrical plug 20 will be generally flush against the outer surface 24 of the electrical outlet 22.

A conventional electrically conductive wire member 56 is connected in electrically conductive relation, preferably by crimping, to each of the respective electrically conductive blade members 50 at the land portion 52 thereof. An opposite end of each of the wire members 56 extends outwardly from the main body member 30 at the perimeter edge 36 thereof in a direction substantially parallel to, and also generally between, the first and second planes of the main body member 30, so as to form an electrical cable.

A molded plastic removal handle 60 is attached to the main body member 30 of the molded plastic low profile electrical plug 20 at the removal handle receiving aperture 40. The molded plastic removal handle 60 has a base portion 61 and a handle portion 62 joined in flexible relation to the base portion 61 by way of a thin plastic living hinge 63. The base portion 61 of the molded plastic removal handle 60 comprises an abutment surface 65 that is in intimate contact with the co-operating mating surface 35, which is recessed slightly from the back face 34 of the molded plastic main body member 30, when the molded plastic removal handle 60 is in place in the main body member 30. In actuality, the abutment surface 65 is divided into a first portion **65*a* and a second portion 65*b*, which first and second portions 65*a* and 65*b* are separated by a centrally disposed nose portion 67. The second portion 65*b* has a cut-out 59 therein, which cut-out accommodates the wire members 56. The nose portion 67 is rounded and its leading edge 69 and is tapered at a side edge 71 thereof, which said side edge 71 adjoins the leading edge 69, so as to permit easy insertion of the base portion 61 of the removal handle 60 into the removal handle receiving aperture 40**.

The base portion 61 further comprises a rearward facing flange 73, which flange 73 intersects the side edge 71 at a vertex 75. The rearward facing flange 73 abuts against a co-operating front facing opposed catch surface 64 on the handle portion 62, thereby locking the base portion 61 of the molded plastic removal handle 60 in place in the main body member 30. Accordingly, any pulling forces on the molded plastic removal handle 60 would be transmitted from the rearward facing flange 73 of the base portion 71 to the forward facing catch surface 64 on the main body member 30.

In this manner, the base portion 61 of the molded plastic removal handle 60 is situated within the removal handle receiving aperture 40 such that the main body member 30 and the base portion of the removal handle 60 are in interference fit with each other so as to securely retain the removal handle 60 in the removal handle receiving aperture 40. The molded plastic removal handle 60 therefore cannot be removed from the main body member 30 of the molded plastic low profile electrical plug 20, at least without being permanently deformed or damaged in some manner. This means that any pulling forces on the molded plastic removal handle 60 would be transmitted from the rearward facing flange 73 of the base portion 61 to the forward facing catch surface 64 on the main body member 30.

The handle portion 62 of the removal handle 60 is flexibly movable between an in-use position and an off-set position. In the in-use position, the removal handle 60 is used to pull the molded plastic low profile electrical plug 20 from an electrical outlet 22, by way of grasping the handle portion 62 and pulling outwardly from the electrical outlet 22. In the in-use position, the handle portion of the molded plastic removal handle 60 extends generally perpendicularly outwardly from the back face 34 of the main body member 30, so as to be readily graspable and so that the resultant line of action of the pulling force acting on the handle portion 62 and transmitted through the molded plastic removal handle 60 is oriented generally parallel to the longitudinal axis "A" of the two electrically conductive blade members 50.

In its off-set position, the handle portion 62 of the removal handle 60 is juxtaposed the back face 34 of the main body member 30, and is preferably locked in place by way of a locking flange 38 at the side of the main body member 30. The locking flange 38 is preferably triangularly shaped in cross-section and releasably engages a co-operating lip member 66 on the handle portion 62. To release the handle portion 62 of the molded plastic removal handle 60 from its off-set position, the outer end 68 of the handle portion 62 protrudes beyond the perimeter edge 36 of the main body member 30, and the outer end 68 is lifted by way of a user's finger such that the handle portion 62 deforms elastically to a small degree so as to cause the lip member 66 to clear the locking flange 38 on the main body member. In the preferred embodiment, there is a reinforcing portion 39 on the main body portion 30, which reinforcing portion 39 reinforces the main body member 30 at the area of the locking flange 38. The handle portion 62 of the molded plastic removal handle 60 comprises an aperture 70 therein, which aperture 70 is shaped and dimensioned so as to accommodate the reinforcing portion 39 of the main body member 30 therein when the handle portion 62 of the molded plastic removal handle 60 is in its off-set position.

The molded plastic main body member 30 and the molded plastic removal handle are each made from a plastic material selected from the group consisting of polypropylene, nylon, polyvinylchloride, polyethylene, and co-polymers of polypropylene and polyethylene, as these materials provide the necessary characteristics of strength and flexibility.

There is also a triangularly shaped protruding support ridge 77, protruding from a flat area behind the rearward facing flange 73 of the nose portion 67, which protruding support ridge 77 contacts an opposed contacting portion 70 of the inner surface 72 of the handle portion 62. In this manner, the handle portion 62 is supported at the area of the thin plastic living hinge 63. The living hinge 63 is thereby precluded from collapsing when the handle portion 62 is in its off-set position, which might otherwise happen under certain conditions.

In an alternative embodiment, it is envisioned that the main body member has two removal handle receiving apertures and the removal handle has two leg portions so as to ge generally configured in the shape of a "U", with the two leg portions being inserted one each into a respective one of the two removal handle receiving apertures. The removal handle receiving apertures are preferably either located along a centre line bisecting the two electrically conductive blade members; or, alternatively, the two removal handle receiving apertures may be outside the area between the two electrically conductive blade members, but in that case should be at equal distances from that bisecting centre line.

Although the present invention has been described and illustrated as a two blade electrical plug, it is possible to have a similarly configured molded plastic low profile electrical plug, as described herein, with an electrically conductive ground pin securely retained by the main body member and extending outwardly from the front face of the main body member—in other words, what is commonly known as a three prong electrical plug.

Other modifications and alterations may be used in the design and manufacture of the apparatus of the present invention without departing from the spirit and scope of the accompanying claims.

What is claimed is:

1. A molded plastic low profile electrical plug comprising:

a thin molded plastic main body member having a generally flat front face in a first plane, a back face in a second plane substantially parallel to said first plane, and a perimeter edge adjoining said front and back faces, and at least one removal handle receiving aperture open to said back face of said main body member;

two electrically conductive blade members securely retained by said main body member and extending outwardly from said front face thereof in a pattern suitable for insertion into a standard electrical outlet with each of said blade members having a generally centrally disposed longitudinal axis oriented substantially perpendicularly to said generally flat front face of said main body member, and said blade members are oriented parallel to one another;

two wire members each connected at a terminating end thereof in electrically conductive relation to a respective one of said blade members, and with the opposite end of each of said wire members extending outwardly from said main body member of said plug at said perimeter edge generally between said first and second planes; and a molded plastic removal handle having a base portion and a handle portion joined in flexible relation to said base portion, with said base portion being situated within said removal handle receiving aperture such that said main body member and said base portion of said removal handle are in interference fit with each other, so as to securely retain said removal handle in said removal handle receiving aperture;

wherein said handle portion is flexibly movable between an in-use position and an offset position;

whereby, when said handle portion is in its in-use position it extends generally perpendicularly outwardly from said back face of said main body member so as to be readily graspable and such that the resultant line of action of a pulling force transmitted through said molded plastic removal handle is oriented generally parallel to said longitudinal axes of said two electrically conductive blade members, and having an effective point of application located substantially midway between said two electrically conductive blade members so as to distribute said pulling force relatively evenly between said two electrically conductive blade members, to thereby facilitate ready removal of said electrical plug from an electrical outlet;

wherein, when said handle portion is in its offset position it subtends an acute or zero angle with respect to said back face of said main body member; and wherein said base portion of said molded plastic removal handle comprises at least one abutment surface in intimate contact with a co-operating mating surface on said molded plastic main body member, and a flange that is in intimate contact with a co-operating opposed catch surface on the main body member at said removal handle receiving aperture, thereby locking said base portion of said molded plastic removal handle in place.

2. The molded plastic low profile electrical plug of claim 1, wherein said removal handle receiving aperture extends completely through said main body member so as to be open also to said front face of said main body member.

3. The molded plastic low profile electrical plug of claim 1, wherein said removal handle receiving aperture is substantially centrally located in said main body member of said electrical plug between said two electrically conductive blade members.

4. The molded plastic low profile electrical plug of claim 1, wherein said removal handle receiving aperture is an elongate slot disposed substantially midway between said electrically conductive blade members.

5. The molded plastic low profile electrical plug of claim 1, wherein said base portion of said molded plastic removal handle has a leading edge which is rounded, and a side edge adjoining said leading edge which side edge is tapered so as to permit ready insertion of said base portion into said aperture.

6. The molded plastic low profile electrical plug of claim 1, wherein said base portion and said handle portion of said molded plastic removal handle are joined to one another by way of a thin plastic living hinge.

7. The molded plastic low profile electrical plug of claim 1, wherein, when said handle portion of said molded plastic removal handle is in said offset position, it is juxtaposed said back face of said main body member.

8. The molded plastic low profile electrical plug of claim 7, wherein, when in said offset position, said handle portion of said molded plastic removal handle is locked at the side of said main body member by way of a locking flange at the side of said main body member, which locking flange releasably engages a lip member of said handle portion.

9. The molded plastic low profile electrical plug of claim 8, wherein said locking flange on said main body member is triangularly shaped in cross-section.

10. The molded plastic low profile electrical plug of claim 9, wherein said main body member further comprises a reinforcing portion at said locking flange, which reinforcing portion reinforces said main body member at said locking flange.

11. The molded plastic low profile electrical plug of claim 10, wherein said handle portion of said molded plastic removal handle comprises an aperture therein, and said aperture is shaped and dimensioned to accommodate said reinforcing portion of said main body member therein, when said molded plastic removal handle is in said offset position.

12. The molded plastic low profile electrical plug of claim 1, wherein said molded plastic main body member and said molded plastic removal handle are each made from a plastic material selected from the group consisting of polypropylene, nylon, polyvinylchloride, polyethylene, and co-polymers of polypropylene and polyethylene.

13. The molded plastic low profile electrical plug of claim 1, wherein said molded plastic main body member and said molded plastic removal handle are each made from polypropylene.

* * * * *